US010138605B2

(12) United States Patent
Bartolomé Asensio et al.

(10) Patent No.: US 10,138,605 B2
(45) Date of Patent: Nov. 27, 2018

(54) RAILWAY TRACK SLEEPER SQUARING DEVICE AND SELF-PROPELLED MACHINE WHICH COMPRISES THIS DEVICE

(71) Applicant: FERROVIAL AGROMAN, S.A., Madrid (ES)

(72) Inventors: Carlos Bartolomé Asensio, Madrid (ES); Rodolfo Moreno Pérez, Madrid (ES)

(73) Assignee: FERROVIAL AGROMEN, S.A., Madrid (ES)

( * ) Notice: Subject to any disclaimer, the term of this patent is extended or adjusted under 35 U.S.C. 154(b) by 281 days.

(21) Appl. No.: 15/120,430

(22) PCT Filed: Feb. 19, 2015

(86) PCT No.: PCT/ES2015/070114

§ 371 (c)(1),
(2) Date: Aug. 19, 2016

(87) PCT Pub. No.: WO2015/124821

PCT Pub. Date: Aug. 27, 2015

(65) Prior Publication Data

US 2017/0130403 A1 May 11, 2017

(30) Foreign Application Priority Data

Feb. 21, 2014 (ES) ..... 201430240

(51) Int. Cl.
*E01B 29/13* (2006.01)
*E01B 29/10* (2006.01)
(Continued)

(52) U.S. Cl.
CPC ..... *E01B 29/13* (2013.01); *E01B 29/06* (2013.01); *E01B 29/10* (2013.01); *E01B 33/02* (2013.01)

(58) Field of Classification Search
CPC ..... E01B 27/13; E01B 29/06; E01B 29/13; E01B 2203/16
(Continued)

(56) References Cited

U.S. PATENT DOCUMENTS 766,851 A * 8/1904 Ten Eyck ..... E01B 29/20 254/108
3,260,218 A * 7/1966 Pyke ..... E01B 29/13 104/9
(Continued)

FOREIGN PATENT DOCUMENTS

EP 2233638 A2 9/2010
FR 2253874 A1 7/1975
(Continued)

OTHER PUBLICATIONS

International Search Report and Written Opinion for Application No. PCT/ES2015/070114, dated Jun. 3, 2015.

*Primary Examiner* — Zachary L Kuhfuss
(74) *Attorney, Agent, or Firm* — Squire Patton Boggs (US) LLP

(57) ABSTRACT

The purpose of the invention is a railway track (3) sleeper (2) squaring device and the machine which carries this device. The device comprises a first and a second positioning element (1) adapted to be located between pairs of sleepers (2) and for locating at opposite ends of the sleepers (2) and parallel to the direction of the railway track (3) where these positioning elements (1) can be extended in that direction with the first and second positioning element (1) being configured such that on extending them simultaneously to a pre-set value they push the sleepers (2) so as to produce squaring of these sleepers (2).

11 Claims, 3 Drawing Sheets

(51) Int. Cl.
*E01B 29/06* (2006.01)
*E01B 33/02* (2006.01)

(58) Field of Classification Search
USPC ..... 104/6, 8
See application file for complete search history.

(56) References Cited

U.S. PATENT DOCUMENTS

| | | | | |
|---|---|---|---|---|
| 3,451,349 | A * | 6/1969 | Yard | E01B 29/13 104/9 |
| 4,903,608 | A * | 2/1990 | Theurer | E01B 27/17 104/12 |
| 8,074,575 | B2 * | 12/2011 | Aguirre Fernandez | E01B 29/06 104/2 |
| 2017/0030023 | A1 * | 2/2017 | Lopez Bueno | E01B 29/13 |
| 2017/0130403 | A1 * | 5/2017 | Bartolome Asensio | E01B 33/02 |

FOREIGN PATENT DOCUMENTS

| | | | |
|---|---|---|---|
| GB | 2159560 | A | 12/1985 |
| SU | 751880 | A1 | 7/1980 |

* cited by examiner

RAILWAY TRACK SLEEPER SQUARING DEVICE AND SELF-PROPELLED MACHINE WHICH COMPRISES THIS DEVICE

FIELD OF THE INVENTION

The invention refers to a device suitable for non-manual positioning and squaring of sleepers, once the rail has been placed. Also the subject of this invention is the self-propelled machine to which this device can be coupled.

BACKGROUND OF INVENTION

During laying of railway tracks, the following operations are carried out:

- Firstly, the sleepers are unloaded at the sides of the route.
- Spreading of the bed is then performed using a ballast spreader. The sleepers will be supported on this bed.
- Positioning of the sleepers on the ballast bed. This operation brings the sleepers close to their final position in coordinates, i.e. position and perpendicularity with respect to the track axis and constant separation between sleepers.
- Unloading of rails onto the previously positioned sleepers.
- Manual sleeper squaring by a gang of workers. During this operation, the separation between sleepers and their position with respect to the track axis need to be in their final position.
- Fixing of fastenings securing the rail to the sleepers.
- Ballasting and levelling operations until the track is in its final position.

According to the above, before fixing the fastenings securing the rail to the sleepers, the sleepers need to be in the correct position, equidistant from each other at a specific distance, as well as positioning them perpendicular to the track axis and centring them on it, all within the tolerances demanded by the corresponding regulations. This activity is known as sleeper squaring.

This process is currently performed manually by several workers equipped with metal bars which they use as levers to drag and move the sleeper into its correct final position. Similarly, a square is used for manual checking of the perpendicularity of each of the sleepers with respect to the rails and its correct distance from the neighbouring sleeper.

This manual process is both slow and imprecise. Currently and due to the advanced state of the art, the outputs for the various types of work listed above are high. As an example, the following outputs for laying single track are included:

1. Bed laying: 2,000 linear meters of single track/day.
2. Sleeper positioning: 2,000 linear meters of single track/day.
3. Rail unloading: 4,000 linear meters of single track/day.
4. Sleeper squaring by a gang of workers: 1,750 linear meters of single track/day, with a team made up of six workers, two with the square marking the sleeper position and four with crowbars locating the sleeper in its position.
5. Fixing of fastenings: 4,000 linear meters of single track/day with four workers with fastening tools.

As can be seen from the outputs above, the sleeper squaring operation represents a bottleneck for the unloading, squaring and fixing operations, hence the clear need to improve squaring outputs is seen.

Also known in the state of the art is application number ES2326403, which describes a machine for positioning and squaring sleepers. This machine is constituted of a wagon which can be moved over the rails, which has metal profiles arranged at its side longitudinally at the level of the track sleepers that have a series of equally spaced wedges that are the parts responsible for coming into contact with and positioning the sleepers, such that the wedges are located between them, pushing them laterally and longitudinally until they leave them in the correct position, i.e. centred, perpendicular to the axis, aligned and separated from each other by a specific distance.

However, the above mentioned positioning machine has the disadvantage that, on performing positioning using wedges, these compress the sleepers on their longitudinal axis and this compression can be excessive, such that some sleepers can break during the squaring task.

The present invention resolves the aforementioned disadvantages by means of a squaring device.

DESCRIPTION OF THE INVENTION

The railway track sleeper squaring device, the purpose of the invention, comprises the following elements:

- at least a first and second positioning element adapted to be located between the pairs of consecutive sleepers and for locating at opposite ends of the sleepers and parallel to the direction of the railway track, where these positioning elements can be extended in this direction;
- a frame joined to the first and to the second positioning element;
- a first and a second stop joined to the frame, where each stop comprises a first part and a second part arranged facing the first and the second positioning element, being configured in such a way that in use they are located on the external face of the two end sleepers to be positioned and where at least one of the first or second stops can be extended in the direction parallel to the track; and
- where the first and the second positioning element and the stop that can be extended are configured such that in their simultaneous extension to a predetermined value, they push the sleepers so as to square them.

Therefore, the positioning elements are located between consecutive sleeper and are shorter than the separation between these sleepers when correctly positioned, which enables them to be inserted between pairs of consecutive sleepers. They can be designed to be located in an arrangement centred with respect to these sleepers. Once inserted between the sleepers, the positioning element can be extended according to the track direction, such that it extends at one or both ends to a pre-set length corresponding to the separation that needs to exist between consecutive sleepers. When the positioning element extends it pushes the side of that sleeper located at less than the pre-set distance and moves it to this pre-set position.

One advantage of the invention is that the device allows itself to be adapted to different regulation distances between sleepers, as this distance can vary depending on national legislation. The adaptation of the device consists of simply varying the extension capacity of the positioners.

The first and second stops are intended to hold the group of sleepers to be positioned, specifically to hold the sleepers located at the outsides on their outer face, where outer face is understood to be the face which is not located facing any sleeper in the group being positioned. Each stop has its two elements arranged facing the positioning elements. At least one of the two stops can be extended, hence the other can be fixed and is positioned in contact with one of the end sleepers, while the stop that can be extended would have the capacity to move the sleeper on the opposite side by extending simultaneously with the positioning elements.

The device can comprise a first and a second positioning element, with which the sleepers would then be positioned two by two, or can comprise several pairs of positioning elements with which they would be able to position several sleepers in a single operation. The positioning elements act simultaneously, enabling the sleepers, which may initially be rotated with respect to the longitudinal axis of the track, to be located in their final position.

Based on that indicated above and taking into account that outputs of 4,000 linear meters of single track/day can be achieved with the device developed with several positioning elements, which can be considered to be an increase in daily production of 130%, resulting in a cost reduction per linear meter of single track of the order of 17%, considering the cost of acquisition, depreciation, workers and appropriate supporting equipment, as well as the extra cost in the traditional method due to low output of the fastening team.

Another of the advantages of this device is that there is no means which, to position the sleepers, applies pressure at both ends of each sleeper relative to its longitudinal axis, which could cause it to break and cause imperfections in the sleeper, but rather the positioners are introduced between the sleepers in a retracted position and subsequently extended so that the sleepers are squared by means of pressure transverse to their longitudinal axis, so avoiding breakages.

Finally, the purpose of this invention is also the self-propelled machine that comprises:

a main body;

wheels that enable it to travel;

a mobile arm; and which is characterised in that it comprises additionally the squaring device according to any of the above claims, joined to the mobile arm by means of its frame.

The self-propelled machine has wheels that enable it to move around the vicinity of the track, such that it is not necessary for the device to be carried by a machine with the capability to move along the railway tracks. This simplifies the operations to be carried out on the track.

DESCRIPTION OF THE FIGURES

To complete the description and in order to provide a better understanding of the invention, a set of drawings is provided. These drawings form an integral part of the description and illustrate embodiment examples of the invention.

DETAILED DESCRIPTION OF THE INVENTION

Figure 1:
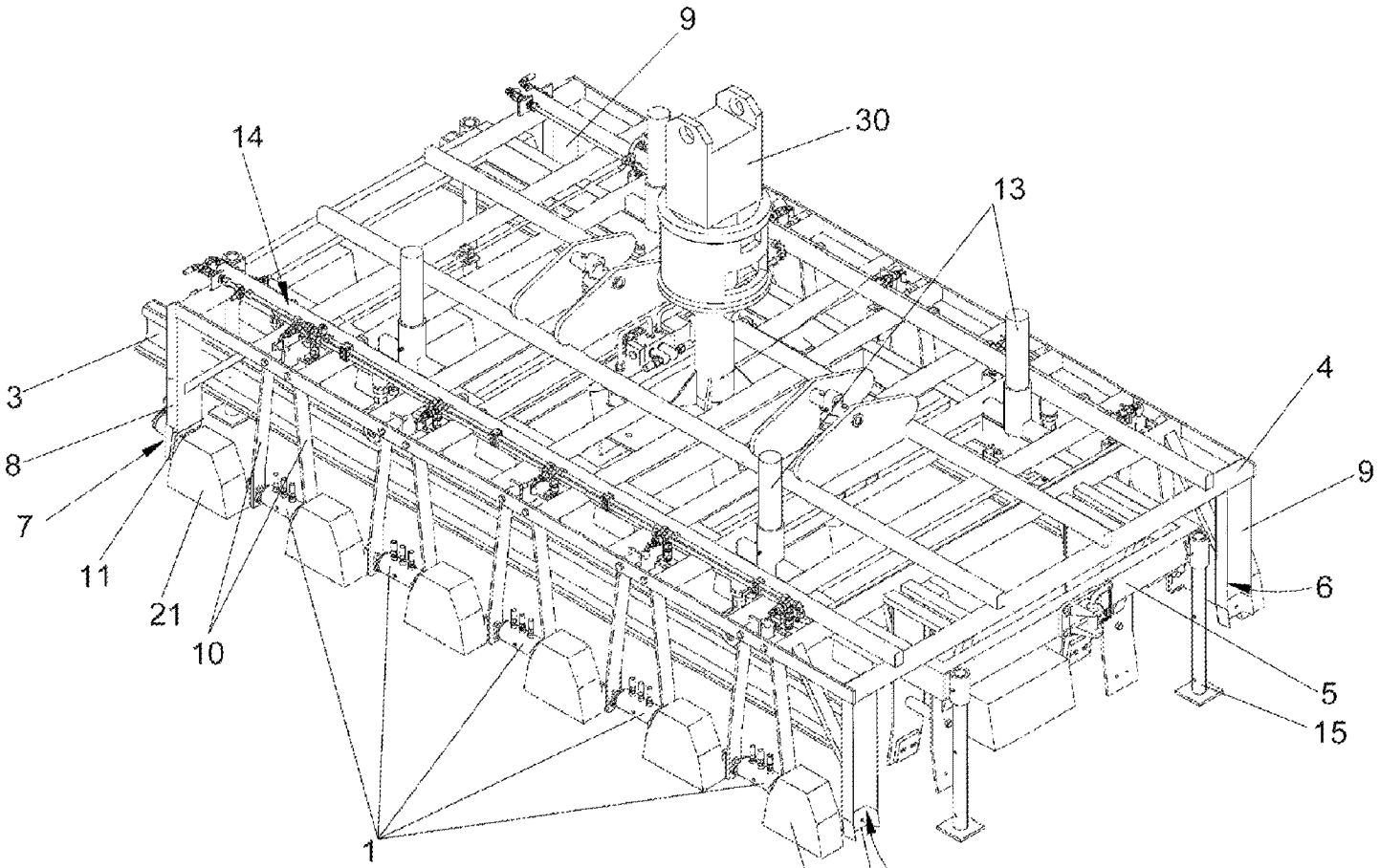
FIG. 1 shows a perspective view of an example embodiment of a squaring unit.
Figure 2:
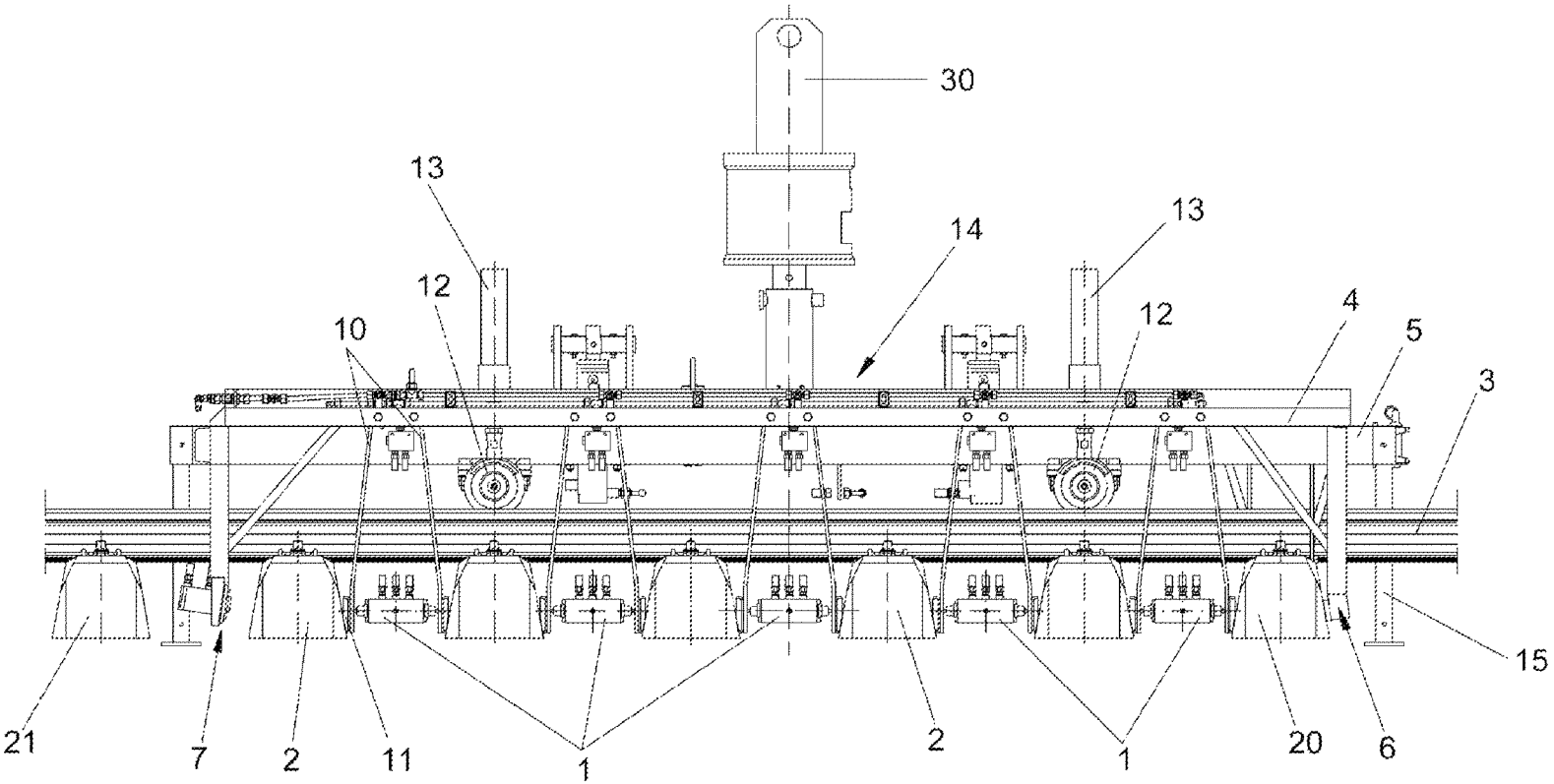
FIG. 2 shows a front view of the example embodiment shown in FIG. 1.
Figure 3:
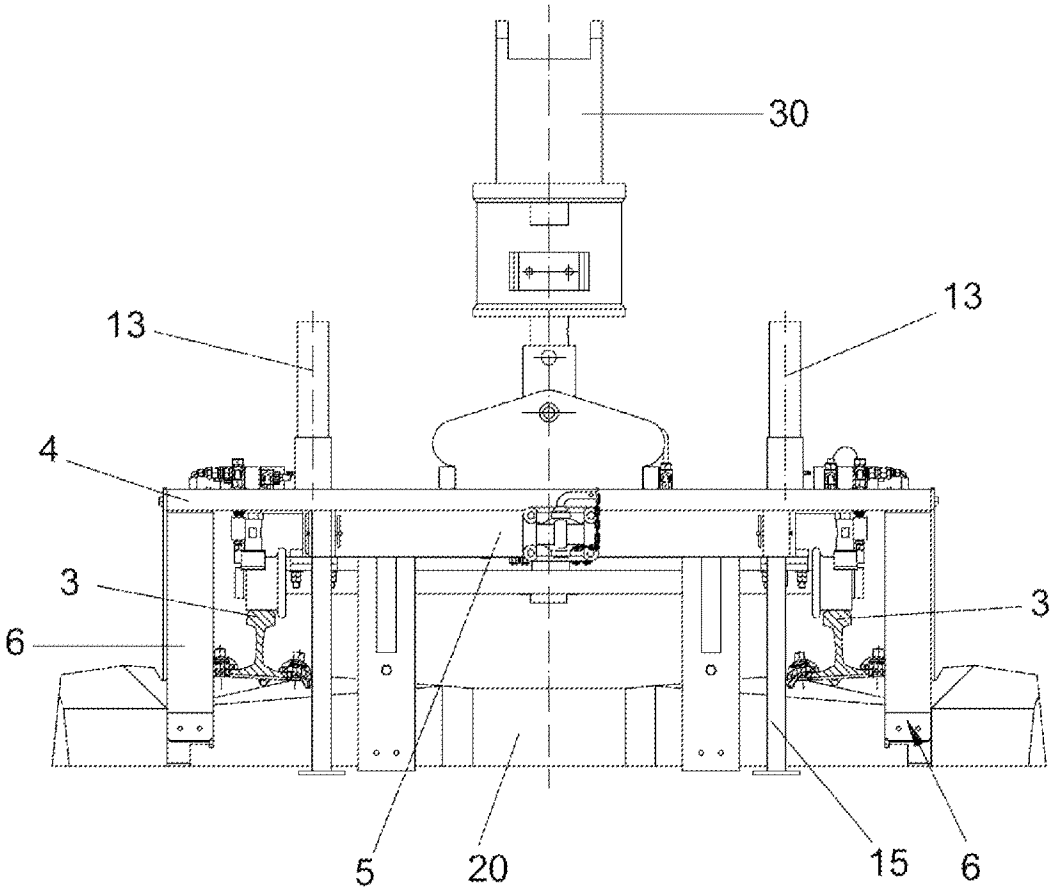
FIG. 3 shows a side view of the example embodiment shown in FIG. 1.

The figures represent an example embodiment that has a first and a second set of positioning elements (1); the first set of positioning elements (1) has five positioning elements (1) located at the ends of six beams (2) which are arranged aligned and equidistant and the second set has another five positioning elements (1) arranged at the opposite ends of these beams (2). In this way, six sleepers (2) can be squared in a single operation.

The positioning elements (1) are located parallel to the direction of the railway track (3), i.e. perpendicular to the sleepers (2) and can be extended in that direction. More specifically, the positioning elements (1) included in the example embodiment comprise hydraulic cylinders.

The frame (4) shown in the figures can be raised such that the positioning elements (1) are inserted between the sleepers (2) by raising and lowering it. Other configurations would be possible, for example, that the positioning elements (1) are inserted in the direction parallel to the longitudinal axis of the sleepers (2) by means of articulated arms.

More specifically, in the example embodiment shown in the figures, the device comprises a first frame (4) to which the positioning elements (1) are joined and a second frame (5) which comprises means for support on the rails (3) and which is arranged connected to the first frame (4) such that the first frame (4) can be raised relative to the second frame (5) as the second frame (5) comprises guides (13) for raising and lowering the first frame (4). In the example embodiment shown, the means for supporting the second frame (5) on the tracks (3) are wheels (12), which enables the device to be moved along the track (3).

Also represented in the figures are the first (6) and second stops (7) joined to the first frame (4). Each stop (6, 7) comprises a first part (8) and a second part (9) arranged facing the first and second set of positioning elements (1). The stops (6, 7) are located on the outside face of the end sleepers (20, 21).

In the squaring operation, one of the stops (6) is located in contact with the first sleeper (20). To do this, this first sleeper (20) must be aligned manually, as it is the reference for locating the device which is the purpose of the invention. The other stop (7) can be extended and in the example embodiment comprises a hydraulic cylinder. The manual alignment of the first sleeper (20) is performed solely with the first group of six sleepers (2), as in subsequent phases the last sleeper (21) will be the first sleeper (20) in the following phase.

The positioning elements (1) are arranged joined to the first frame (4) by means of two extensions (10) joined at their top ends to that frame (4) and at their bottom ends to the ends of the positioning elements (1), such that in the extended position of these positioning elements (1), this bottom end is located between the positioning elements (1) and the sleepers (2).

In order to cause the minimum possible damage to the sleepers (2), the extensions (10) comprise a shock absorbing element (11) on their face facing the sleepers (2), which can also be made available on the internal face of the stops (6, 7).

Also represented in the figures attached is the hydraulic facility (14) that enables the extension and retraction of the hydraulic cylinders.

The device also has an additional support element (15) which provides the assembly with stability.

The example embodiment is also characterised in that the second frame (5) comprises means for coupling (30) it to a self-propelled machine that also has a hydraulic or pneumatic system that supplies the hydraulic (14) or pneumatic system referred to above. The self-propelled machine can be any machine capable of moving in the vicinity of the track (3) and, therefore, there is no need for a device which necessarily needs to move along the track (3), which makes squaring operations more difficult and causes delays in them.

The invention claimed is:

1. A railway track sleeper squaring device, characterised in that it comprises:

at least a first and second positioning element adapted to be located between two consecutive sleepers and adapted to be located at opposite ends of the sleepers and parallel to the direction of the railway track, where these positioning elements can be extended in this direction;

a frame joined to the first and to the second positioning element;

a first and a second stops joined to the frame, where each stop comprises a first part and a second part arranged facing the first and the second positioning element, being configured in such a way that in use the first and second stops are located on the external face of the two end sleepers to be positioned and where at least one of the first or second stops can be extended in the direction parallel to the track; and where the first and the second positioning element and the stop that can be extended are configured such that in their simultaneous extension to a pre-set value, they push the sleepers so as to square them.

2. A railway track sleeper squaring device, according to claim 1, characterised in that the railway track sleeper squaring device comprises a first and a second set of positioning elements designed to be located at opposite ends of the sleepers such that the positioning elements in this first and second set are equidistant from each other and aligned.

3. A railway track sleeper squaring device, according to claim 1, characterised in that the frame comprises extensions joined at their top ends to this frame and at their bottom ends to the ends of the positioning element such that in the extended position of this positioning element, the bottom ends are designed to be located between the positioning element and the sleepers.

4. A railway track sleeper squaring device, according to claim 3, characterised in that the extensions comprise a shock absorbing element in their face facing the sleepers.

5. A railway track sleeper squaring device, according to claim 1, characterised in that the frame can be raised such that the frame is adapted such that when the frame is lowered the positioning elements are inserted between the sleepers.

6. A railway track sleeper squaring device, according to claim 1, characterised in that the railway track sleeper squaring device comprises a second frame which comprises means for support on the tracks and is arranged connected to the first frame such that the first frame can be raised with respect to the second.

7. A railway track sleeper squaring device, according to claim 6, characterised in that the means of support of the second frame on the tracks are wheels.

8. A railway track sleeper squaring device, according to claim 6, characterised in that the second frame comprises guides for moving the first frame.

9. A railway track sleeper squaring device, according to claim 6, characterised in that the second frame comprises means for coupling the second frame to a self-propelled machine that can be moved around the vicinity of the track.

10. A railway track sleeper squaring device, according claim 1, characterised in that the positioning elements comprise hydraulic cylinders.

11. A self-propelled machine that comprises:

a main body;

wheels that enable it to travel;

a mobile arm; and characterised in that the self-propelled machine comprises additionally the squaring device according claim 1, joined to the mobile arm by means of its frame.

* * * * *